US006240617B1

(12) United States Patent
Nitoh et al.

(10) Patent No.: US 6,240,617 B1
(45) Date of Patent: Jun. 5, 2001

(54) LARGE UNIT WEIGHT HOT ROLLING PROCESS AND ROLLING APPARATUS THEREFOR

(75) Inventors: Takatsugu Nitoh; Hidehiko Kimishima, both of Tokyo (JP)

(73) Assignee: Kawasaki Steel Corporation

( * ) Notice: Subject to any disclaimer, the term of this patent is extended or adjusted under 35 U.S.C. 154(b) by 0 days.

(21) Appl. No.: 09/194,071

(22) PCT Filed: Apr. 2, 1998

(86) PCT No.: PCT/JP98/01528

§ 371 Date: Nov. 19, 1998

§ 102(e) Date: Nov. 19, 1998

(87) PCT Pub. No.: WO98/45062

PCT Pub. Date: Oct. 15, 1998

(30) Foreign Application Priority Data

Apr. 4, 1997 (JP) ..... 9-086227

(51) Int. Cl.[7] ..... B22D 11/12

(52) U.S. Cl. ..... 29/527.7; 29/33 C; 72/231

(58) Field of Search ..... 29/527.7, 33 C; 72/231

(56) References Cited

FOREIGN PATENT DOCUMENTS 59-92103 * 5/1984 (JP) .
6-88072 * 11/1994 (JP) .
7-61488 * 7/1995 (JP) .

* cited by examiner

*Primary Examiner*—P. W. Echols
(74) *Attorney, Agent, or Firm*—Austin R. Miller

(57) ABSTRACT

A sheet bar having a thickness of 20 to 50 mm, as continuously cast by a sheet bar caster, is passed as it is through a first sheet bar twister and is then wound in an up-end state into an up-end sheet bar coil. Then, this up-end sheet bar coil is rewound, passed through a second sheet bar twister, finish-rolled and wound into a hot coil. As compared with the slabbing—high draft rolling process of the prior art, the invention is advantageous in that it can improve the quality, production yield and production efficiency and can reduce the cost for an apparatus such as the cost for its construction and maintenance.

20 Claims, 7 Drawing Sheets

× : WITH COIL DEFORMATION

○ : WITHOUT COIL DEFORMATION

LARGE UNIT WEIGHT HOT ROLLING PROCESS AND ROLLING APPARATUS THEREFOR

TECHNICAL FIELD

The present invention relates to a large unit weight hot-rolling process capable of continuously rolling at a large unit weight (i.e., at the unit of one charge of a steel strip) of 50 to several hundreds tons, and a rolling apparatus for the process.

BACKGROUND ART

In the prior art, a hot strip is generally made by heating a slab, prepared by a continuously casting method or a ingot making-bloom rolling method, heated again in a heating furnace and, subsequently, by coarsely hot-rolling and finish-rolling the heated slab. However, this process requires a slab reheating step so that it is disadvantageous in high fuel consumption. Moreover, a standby capability is made indispensable in portions of the slab yard or the heating furnace so that a large unit weight long slab has problems in its handling or maintenance. Moreover, rolling is difficult for large unit weight pieces so that it is performed for the slab at the unit of about 10 to 30 tons.

In this rolling, however, each coil has uneven portions at its leading and trailing end portions which leaves problems of product quality and production yield unsolved.

In order to solve these problems, there has been proposed a rolling process for performing the casting and hot-rolling steps completely continuously.

This completely continuous rolling process is thought to have the following advantages.

(1) The rolling and forming are performed directly from the continuous casting machine while requiring no re-heating so that fuel consumption efficiency is improved.

(2) In non-continuous rolling, each rolling material has to be smoothly gripped between the upper and lower rolls of the coarse-rolling mill group and the finish-rolling mill group so that each rolling material has to be adjusted in its leading end shape and its thickness. In completely continuous rolling, however, the adjustment is not required.

(3) In non-continuous rolling, the temperatures of the leading and trailing ends of each rolling material become lower and invite the disadvantage that the formed products are heterogeneous in qualities. However, the completely continuous casting is free from this disadvantage.

(4) In non-continuous rolling, there arise between the preceding rolling material and the succeeding rolling material the time and mechanical spaces in which the rolling actions are not made, so that the effective availability of the precious rolling mill is lowered, which degrades productivity. However, the completely continuous rolling is free from this disadvantage.

(5) In non-continuous rolling, when each rolling material is gripped at its leading end by the rough rolling group and the finish-rolling group, shocks occur so that the rolling mill has to be designed to have a strength capable of withstanding the shocks. The completely continuous rolling has little shock so that it is advantageous in the design of the strength of the rolling mill.

As described above, completely continuous rolling can advantageously solve the problems of the non-continuous rolling of the prior art. At this stage, however, the casting capacity of each continuous casting machine is far inferior to that of the rolling mill so that the process cannot be large-scale.

The following points are noted considering the existing process for making hot strip. Specifically, the steel is made at every charge (of 50 to 300 tons) by batch operation determined by the capacity of the converter or the electric furnace. In view of the order of construction of the hot strip, on the other hand, most lots of equal width and thickness are made in units of 50 to 100 tons on an average.

If a continuous rolling at the unit of at least one charge is possible, therefore, even non-continuous rolling can expect effects similar to those of the completely continuous rolling.

As based on the concept thus far described, we have previously proposed a hot strip rolling process, as disclosed in Unexamined Published Japanese Patent Application No. 59-92103, which enables a rolling capacity similar to that of the continuous rolling, although non-continuous, by dividing the rolling step into a former step and a latter step so that a plurality of rolling mills capable of performing a high draft rolling according to the rolling capacity of the downstream rolling mill are arranged at the former step, and by suitably rewinding the sheet bar, as wound in an up-end state at the former step. By developing this hot strip rolling process, productivity is remarkably improved.

In this rolling process, the slab is rolled, after being continuously cast, into such a sheet bar by the high draft rolling mill which is wide enough for later finish rolling. However, this process has a problem that the hot-rolled steel sheet products are frequently defective at their surfaces by scale biting scratches or roll marks due to the high draft rolling when the sheet bar is made so that the percentage of defective products is high. Another problem is that the work rolls of the high draft rolling mill are seriously worn on their surfaces to make it necessary to replace them so that the initial target of the rolling operation matching the rolling capacity of the downstream rolling mill cannot be achieved.

The invention has an object to provide a hot-rolling process which is improved from the aforementioned hot strip rolling process to lower the product cost more and improve product quality, and a rolling apparatus for the process.

DISCLOSURE OF THE INVENTION

We have investigated the causes for the scale biting scratches in the hot-rolled steel sheet products and have found that the scale biting scratches are seriously influenced by the thickness reduction at the previous rolling for manufacturing the sheet bar to be finish-rolled.

When a steel strip, as continuously cast, is to be rolled without any heating, more specifically, it has been found that the scale bite is caused at such a low draft of 10 to 20% in the former rolling as compared with that of the case in which the continuously cast steel strip is rolled after reheated in the heating furnace. This cause is believed, although not clearly understood, to come from the fact that when the continuously rolled steel strip is to be rolled, a temperature difference occurs in the thickness direction of the steel strip so that the surface temperature is lower than the internal temperature.

Therefore, we have made numerous experiments and investigations by noting that the draft is reduced at the former rolling for making the sheet bar to be finish-rolled and that the temperature difference between the surface and the inside of the steel strip is reduced at the time of performing the former rolling.

The intended object has been achieved more than expected, by trying the use of the sheet bar caster in place of the slabbing—high draft rolling process which was previously developed by us.

The invention has been based on the discoveries thus far described.

Specifically, the invention can be described as follows.

1. A large unit weight hot-rolling process for sheet bars, comprising: the step of passing a sheet bar having a thickness of 20 to 50 mm, as continuously cast by a sheet bar caster, as it is through a first sheet bar twister and then winding it in an up-end state into an up-end sheet bar coil; and the step of unwinding said up-end sheet bar coil, finish-rolling it through a second sheet bar twister and winding it into a hot coil, and a rolling apparatus for the process.

2. A large unit weight hot-rolling process for sheet bars, comprising: the step of passing a sheet bar having a thickness of 20 to 50 mm, as continuously cast by a sheet bar caster and then lightly drafted for shape or quality adjustment, through a first sheet bar twister and then winding it in an up-end state into an up-end sheet bar coil; and the step of unwinding said up-end sheet bar coil, finish-rolling it through a second sheet bar twister and winding it into a hot coil, and a rolling apparatus for the process.

3. A large unit weight hot-rolling process for sheet bars according to the item 2, wherein the light drafting is performed at a draft of 3 to 10%.

4. A large unit weight hot-rolling process for sheet bars according to the item 1, 2 or 3, wherein a plurality of sheet bar casters according to the rolling capacity one finish-rolling array are arranged in parallel and are run sequentially at the time interval which is determined by a rolling rate determined according to the production plan of said finish-rolling equipment line.

5. A large unit weight hot-rolling process for sheet bars according to any of the items 1 to 4, wherein said sheet bar coil has a unit weight of 50 tons or more.

6. A large unit weight hot-rolling process for sheet bars according to any of the items 1 to 5, wherein when a hot-rolled steel strip to be finish-rolled has a thickness of 1.6 mm or less, said thickness of sheet bar is 40 mm or less.

7. A large unit weight hot-rolling process for sheet bars according to any of the items 1 to 6, wherein before the finish rolling, the portions corresponding to the inner side and the outer side of said up-end sheet bar coil are heated.

8. A large unit weight hot-rolling process for sheet bars according to any of the items 1 to 7, wherein before the finish rolling, the upper and/or lower sides of said up-end sheet bar coil are heated.

9. A large unit weight hot-rolling process for sheet bars according to any of the items 1 to 6, wherein before the finish rolling, said up-end sheet bar coil is heated or thermally holded as a whole.

By combining the omission of the high draft rolling and the exploitation of the sheet bar caster organically, according to the invention, the scale biting scratches of the hot-rolled steel sheet product are effectively prevented, although there may be problems in the rolling process as disclosed in Unexamined Published Japanese Patent Application No. 59-92103, and the sheet bar is lightly drafted after being continuously cast, to correct the shape and adjust the quality of the sheet bar.

Here, the sheet bar caster cannot be finish-rolled at certain unit weight (of 100 tons at the maximum) or less because of the restrictions on the conditions of transfers from the caster to the finish-rolling group, although a variety of investigations have been made in the prior art.

In order that the sheet bars, as made by a plurality of sheet bar casters, may be rolled by one rolling mill, more specifically, they have to be held without a temperature drop. For this necessity, it is advantageous in the aspects of suppressing the temperature drop and making the apparatus compact that the sheet bars are wound and held in the coiled state. In the process of the prior art for rolling the sheet bars at a down-end state, however, the coil is deformed in its shape by its own shape as its weight increases, so that it cannot be wound before being rolled. This tendency is prominent when the coil weight exceeds 50 tons, so that the coil cannot be completely wound when its weight exceeds 100 tons. When a steel strip is to be made by one set of a sheet bar caster and a finish-rolling group, moreover, the capacity is about 150,000 tons/month at most.

Thus, the sheet bar casting process of the prior art handles the sheet bar caster and the finish-rolling group as one set but has failed to have the concept that a plurality of sheet bar casters are associated with one finish-rolling array. This technical concept has been introduced at first by the invention.

BEST MODE FOR CARRYING OUT THE INVENTION

The invention will be specifically described in the following.

Figure 1A:
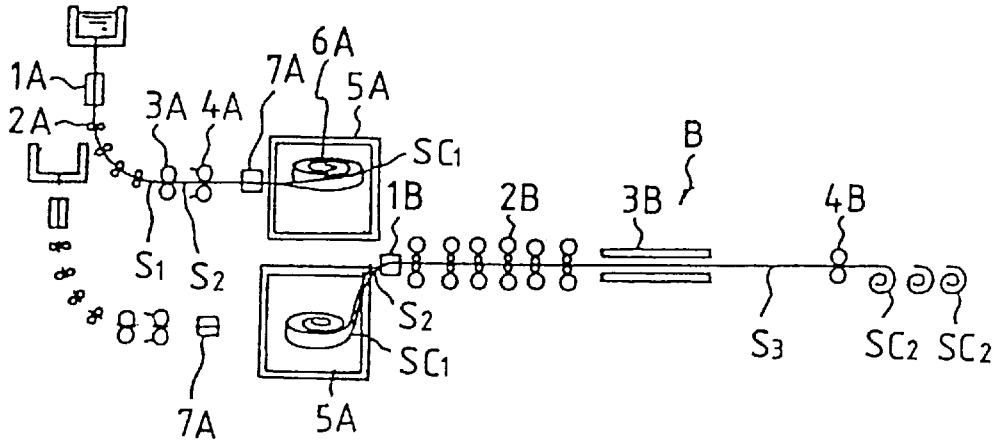
FIGS. 1(*a*) and 1(*b*) are schematic diagrams of a sheet bar caster and a rolling apparatus, as suited for practicing the invention.
Figure 1B:
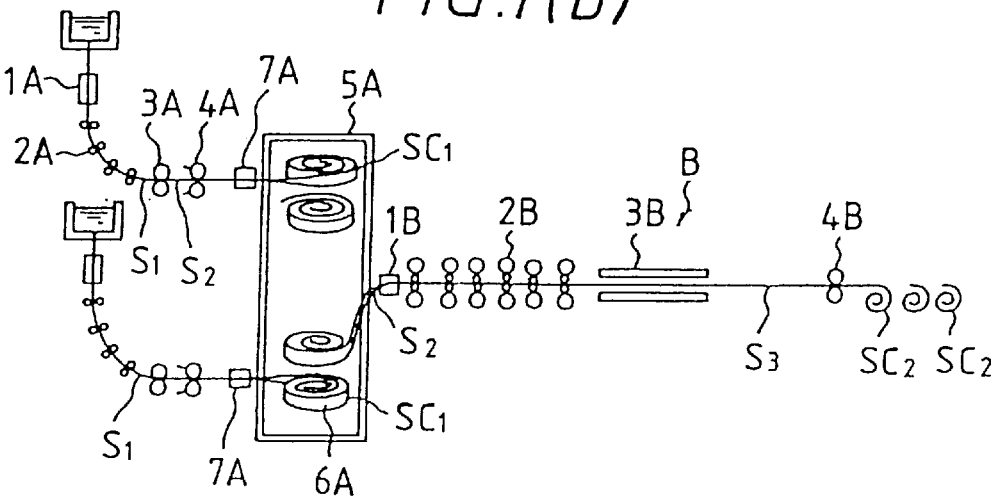
Figure 2:
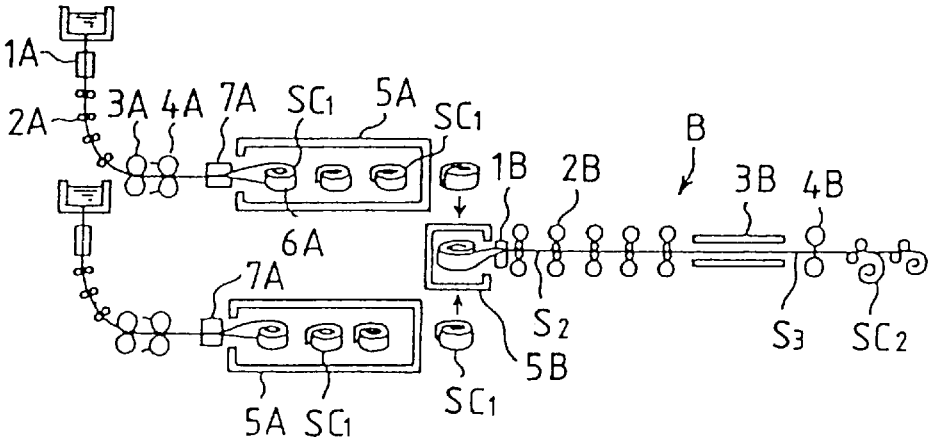
FIG. 2 is a schematic diagram of another sheet bar caster and another rolling apparatus, as suited for practicing the invention.
Figure 3:
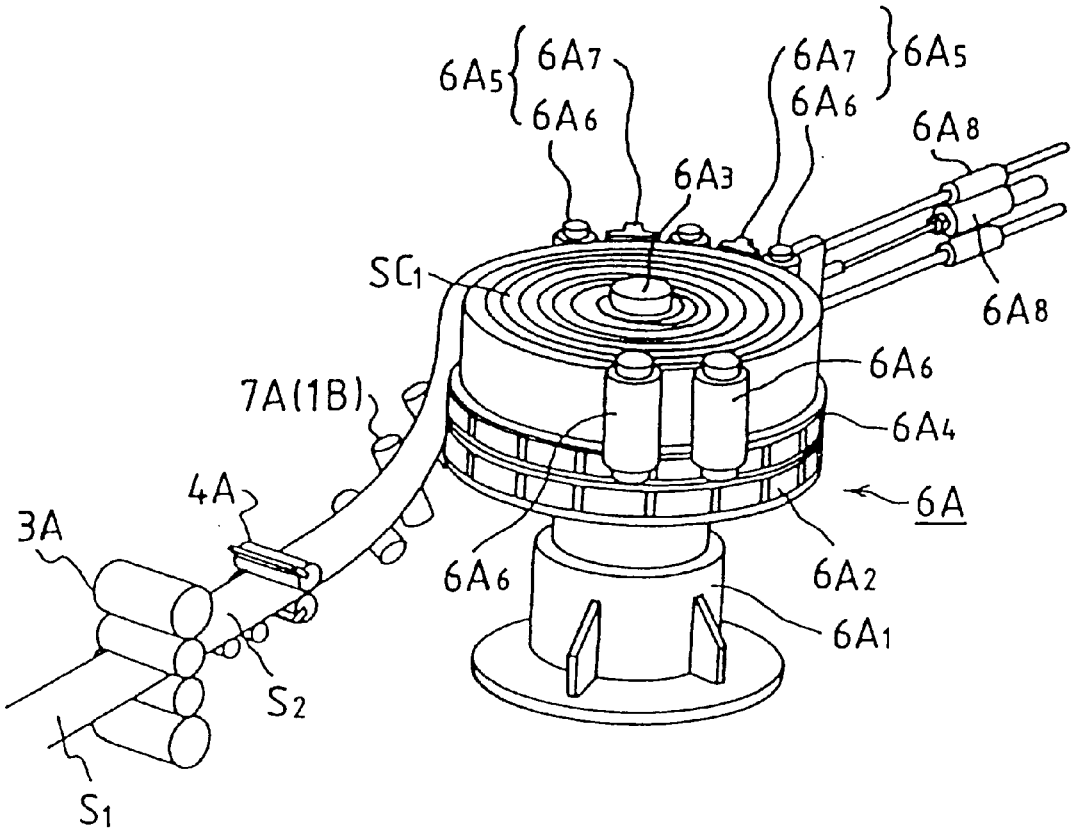
FIG. 3 is a perspective view showing a winder together with a sheet bar twister.

FIGS. 1(*a*) and 1(*b*) and FIG. 2 schematically show a sheet bar caster and a finish rolling equipment line, as suited for practicing the invention, and FIG. 3 perspectively shows a representative winder together with a sheet bar twister. In these Figures: reference numeral 1A designates a sheet bar caster; numeral 2A pinch rolls; numeral 3A a rolling mill for shape or quality adjustments; numeral 4A a flying shear; numeral 5A a heat holding chamber; numeral 6A a winder; numeral 6A1 a support bed; numeral 6A2 a turntable; numeral 6A3 a mandrel; numeral 6A4 a coil holding plate; numeral 6A5 guide mechanisms; numeral 6A6 guide rolls; numeral 6A7 guide plates; numeral 6A8 cylinders; numeral 7A a first sheet bar twister; numeral 1B a second sheet bar twister; numeral 2B a finish-rolling mill group; numeral 3B a cooling unit 3B; and numeral 4B a flying shear. Here in the invention, either a sheet bar S1 continuously cast by the sheet bar caster 1A and not rolled by rolling mill 3A or a sheet bar S2 lightly rolled by the rolling mill 3A is wound in an up-end state into an up-end sheet bar coil SC1. At this time, the sheet bar caster should not be especially restricted but can be exemplified by any of the prior art. However, the sheet bars S1 and S2 have to be so thick that they can be subjected to a later finish hot-rolling. Considering that the sheet bar is finish-rolled into a thin steel sheet having a thickness of about 0.8 to 10 mm, it is desired the sheet bars S1 and S2 be given a thickness of 20 to 50 mm (preferably 20 to 40 mm). Here, since the optimum value of the thickness of the sheet bar is different depending upon the desired thickness after finish rolling, it may be desirable to adjust the thickness of the sheet bar by drafting the sheet bar before the winding action.

When the continuous cast sheet bar is wound as it is into a coil, on the other hand, cracks may be caused in the sheet bar surface with the cast structure by bending at the winding time, thereby deteriorating the surface quality of the rolled product. In this case, it is preferable that the sheet bar is rolled, before being wound, to break the cast structure of its surface.

After continuous casting, therefore, the sheet bar is rolled, if necessary, before being wound. If the draft at this time is excessively high, it is possible that the scale is formed, as described hereinbefore.

When the rolling is performed at the entrance side of the winder, on the other hand, the velocity of the sheet bar at the entrance of the rolling mill is equalized to that at the exit of the sheet bar caster so that the rolling rate becomes far lower than that of the hot rolling of the prior art. As a result, an excessively high draft or thickness reduction may deteriorate the quality due to damage to the rolls. At a draft or thickness reduction exceeding 10%, the above-specified drawbacks may probably occur. It is, therefore, preferable that the rolling for correcting the shape or adjusting the quality, as described hereinbefore, is at a draft or reduction as light as about 3 to 10%.

When the continuously cast sheet bar is to be rolled, on the other hand, a danger of inducing the scale bite is not high according to the invention. However, the thinner sheet bar at the casting is the more reluctant to establish a temperature difference between the surface and the inside so that it is advantageous for avoiding the scale biting scratches.

At the aforementioned previous step, in order to wind the sheet bar S2 (including the sheet bar S1, as in the following) taking a horizontal position into an up-end state by the winder 6A, there is disposed at the entrance side of the winder 6A the first sheet bar twister 7A which is composed of a number of rollers and guides for changing the sheet bar S2 from the horizontal position to an upright position. Then, this up-end sheet bar coil SC1 is unwound in the up-end state so that it is formed into a hot strip S3 by a downstream finish-rolling equipment line B. However, the sheet bar S2, as unwound in the up-end state from the up-end sheet bar coil SC1, is corrected into the horizontal position by the second sheet bar twister 1B which has a construction absolutely identical to that of the aforementioned first sheet bar twister 7A. After this, the sheet bar S2 thus corrected is rolled to a desired thickness by the finish-rolling mill group 2B and is adjusted in its quality by the cooling unit 3B. Then, the sheet bar S2 is formed into the hot strip S3 and cut into lengths, as demanded by the flying shear 4B, and is wound and formed into a hot strip coil SC2. Thus, according to the invention, the sheet bar S2 is formed into the up-end sheet bar coil SC1, which is rewound in the up-end state into the hot strip S3. The rolling operation is divided into a former sheet bar making step and a later rolling step because it forms the up-end sheet bar coil SC1.

Here will be compared the capacity of working the up-end sheet bar coil SC1 between-the sheet bar caster 1A and the shape/quality adjusting rolling mill 3A. The finish-rolling equipment line B at the downstream stage, as including the finish-rolling mill group 2B for shaping the up-end sheet bar coil SC1 into the hot strip S3 and the cooling unit 3B, has a far higher rolling capacity. For an advantage of the actual run, therefore, there is combined with one finish-rolling equipment line B a plurality of sheet bar casters 1A matching the rolling capacity of the array B. These plural sheet bar casters 1A are gradually run with the time lag which is required for the finish-rolling equipment line B to roll and shape one up-end sheet bar coil SC1 into the hot strip S3 so that the downstream finish-rolling equipment line B may be continuously run.

Here, when the plural sheet bar casters 1A and one finish-rolling equipment B are combined, it is effective for making the rolling works smoother to interpose the heat holding chamber 5A inbetween.

Here can be conceived a variety of running modes for the combinations of the sheet bar casters 1A and one finish-rolling equipment line B. In the embodiment of FIG. 1(*a*) , for one sheet bar caster 1A, there is arranged in one heat holding chamber 5A the winder 6A having one winding function, so that the up-end sheet bar coil SC1, as wound on the winder 6A of the other sheet bar caster 1A, is wound into the finish-rolled state while the sheet bar S2 is being wound on the single winder 6A. In the embodiment of FIG. 1(*b*) , on the other hand, there is arranged in the heat holding chamber 5A the winder 6A which has two winding functions for one sheet bar caster 1A, so that the up-end sheet bar coil SC1, as wound on one winder 6A, may be in a standby state or a wound state while the sheet bar S2 is being wound on the other winder 6A. In the embodiment of FIG. 1(*b*) , the two sheet bar casters 1A are combined with the single finish-rolling equipment line B, and the two winders 6A are combined with the single sheet bar caster 1A. In other words, there is disposed in the heat holding chamber 5A the four winders 6A which wind and unwind the up-end sheet bar coil SC1 sequentially. In FIG. 1(*b*), the up-end sheet bar coil SC1, as wound on the first winder 6A of the second sheet bar caster 1A, is being wound, and the second winder 6A corresponding to the second sheet bar caster 1A has wound the sheet bar S2 substantially to its half. On the other hand, the second winder 6A of the first sheet bar caster 1A has formed the up-end sheet bar coil SC1 and is in the standby state, but the first winder 6A is at the beginning of winding the sheet bar S2.

In the embodiment of FIG. 2, one winder 6A is combined with one sheet bar caster 1A. In this embodiment, the sheet bar caster 1A is driven prior to the downstream finish-rolling equipment line B to form two or three up-end sheet bar coils SC1 in advance. In this embodiment, the number of winders 6A, as required, can be reduced, and the unwinding function need not be added. Moreover, no special restriction is made on the action timing between the sheet bar casters 1A and between the sheet bar caster 1A and the finish-rolling equipment line B. On the contrary, there arise disadvantages that the standby time period of the formed up-end sheet bar coil SC1 in the heat holding chamber 5A, that the up-end sheet bar coil SC1 has to be removed from the winder 6A, and that there is required a winder 5B especially for unwinding the up-end sheet bar coil SC1. Here will be exemplified a specific combination of the sheet bar caster 1A and the finish-rolling equipment line B. Since the general sheet bar caster 1A has a capacity of about 5,000 tons/strand • day, it is practical to combine two sheet bar casters 1A with the finish-rolling equipment line B having a rolling capacity of 10,000 tons/day.

Here, the arrangement and combinations of equipment, as shown in FIGS. 1(*a*) and 1(*b*), are suited for a rather low production because of the positional and operational restrictions and because of the casting capacity of the sheet bar caster 1A. On the other hand, the array combination, as shown in FIG. 2, is suited for mass production because it accepts any number of up-end sheet bar coils SC1.

The invention can take the form of the various embodiments as described hereinbefore. No matter what the embodiment, however, it is necessary to transform the formed sheet bar S2 into the up-end sheet bar coil SC1.

With reference to FIG. 3, here will be described how to wind the sheet bar S2 into the up-end sheet bar coil SC1.

The winder 6A has a body portion constructed by assembling the turntable 6A2 rotatably with the support bed 6A1 immovably fixed and by erecting the mandrel 6A3 on the center of the upper face of the turntable 6A2. The winder 6A is further constructed by providing the guide mechanism 6A5 which confronts the side of the mandrel 6A3 to wind the sheet bar S2 accurately and smoothly on the mandrel 6A3. The guide mechanism 6A5 includes: a number of guide rolls 6A6 for pushing the sheet bar S2 onto the mandrel 6A3 introduced so as to wind it on the mandrel 6A3; and a suitable number of guide plates 6A7 for guiding the sheet bar S2 introduced, in a direction to wind it on the mandrel 6A3. The individual guide rolls 6A6 are pushed toward the mandrel 6A3 while holding their predetermined positions by the cylinders 6A8. The pushing forces, as applied to the guide rolls 6A6, are active from the beginning of the winding the sheet bar S2 on the mandrel 6A3. By the pushing forces, neither any clearance is left between the turns of the sheet bar S2 wound on the mandrel 6A3, nor is established any frictional displacement between the surfaces of the wound turns. The guide mechanisms 6A5 thus constructed are required only for winding the sheet bar S2, and their individual guide rolls 6A6 and guide plates 6A7 are retracted to refuge positions when in other than the winding actions.

Since the winder 6A to be used in the embodiments of FIGS. 1(*a*) and 1(*b*) has to be given the unwinding function, the turntable 6A2 and the mandrel 6A3 have to be turned idly with respect to the support bed 6A1.

On the contrary, the winder 6A in the embodiment of FIG. 2 need not have the unwinding function but has to be given a function to remove the formed up-end sheet bar coil SC1 from the winder 6A.

As shown, therefore, the turntable 6A2 is overlaid by the removable coil holding plate 6A4 having a flat disc shape, and the mandrel 6A3 can be lowered into the support bed 6A1. As also convenient, after the up-end sheet bar coil SC1 was formed by the winder 6A, the mandrel 6A3 is lowered so that the up-end sheet bar coil SC1 can be removed from the winder 6A while being carried on the coil holding plate 6A4.

In the invention, the sheet bar of 50 tons or more is rolled at one time, the temperature fluctuation is liable to occur in the sheet bar. Especially the inner side and the outer side of the sheet bar coil are liable to take lower temperatures because they have high thermal diffusions. If the winder is of the type in which the sheet bar is wound on the mandrel, as shown in FIG. 3, the inner side of the coil has a large temperature drop. In order to suppress the temperature fluctuation in the sheet bar, therefore, the winder is preferable of the type having no mandrel.

Figure 4:
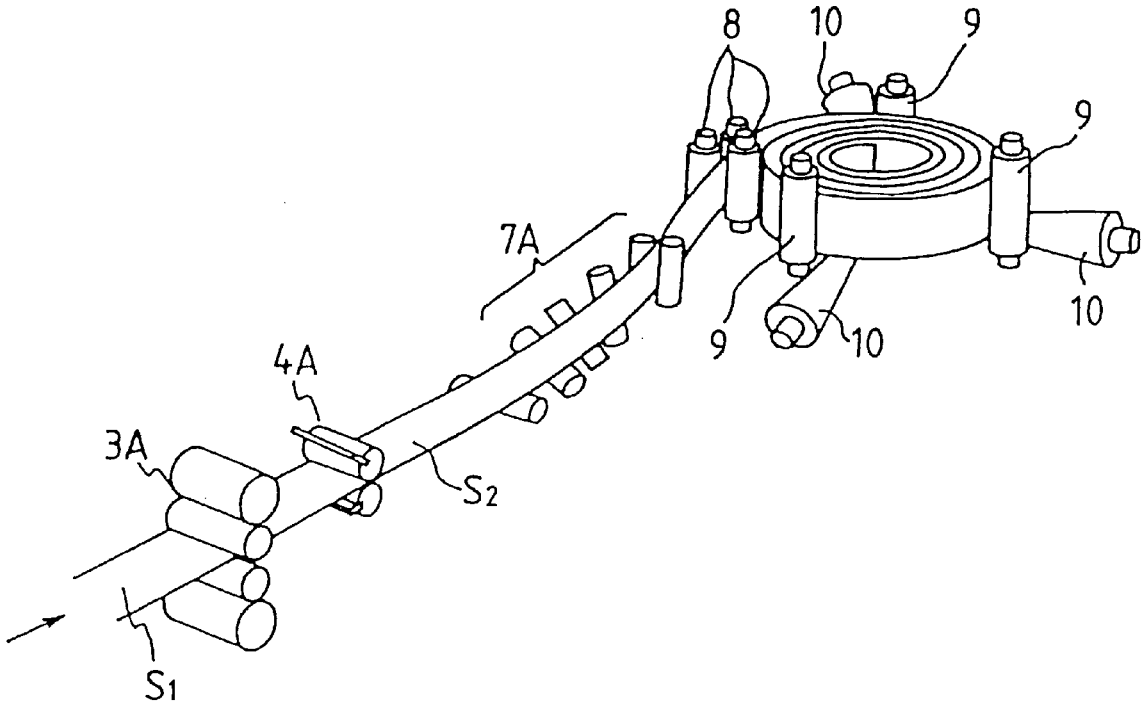
FIG. 4 is a perspective view showing a winder having no mandrel.
Figure 5A:
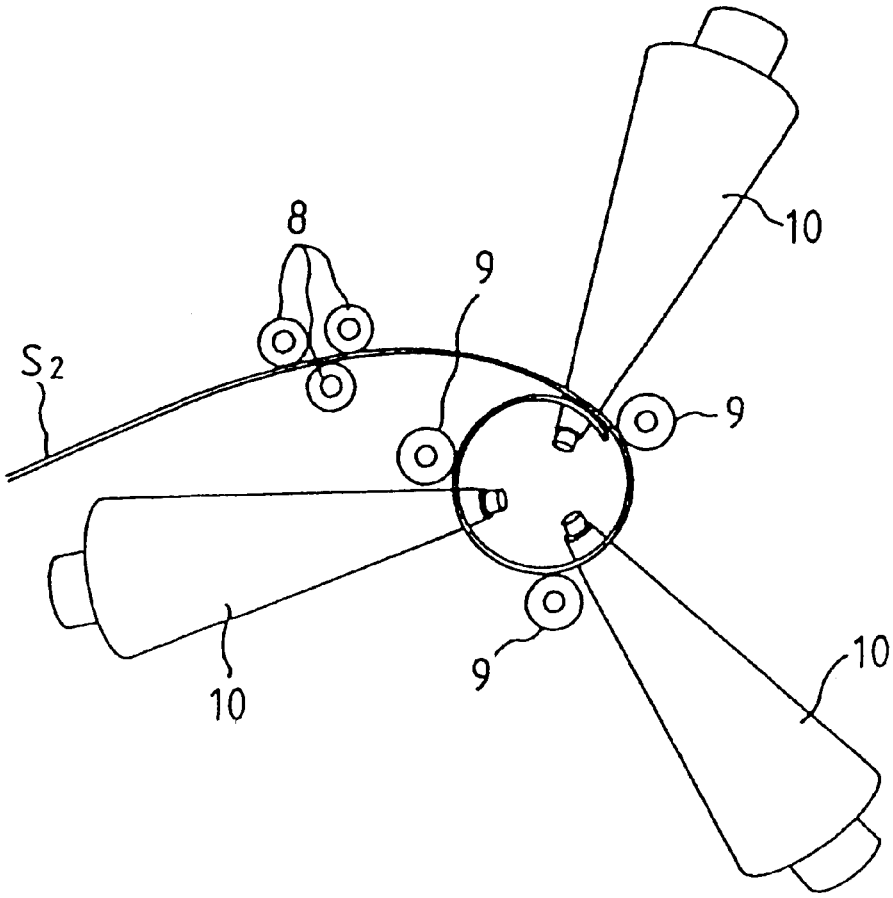
FIGS. 5(*a*) and 5(*b*) are a top plan view and a front elevation of the winder having no mandrel.
Figure 5B:
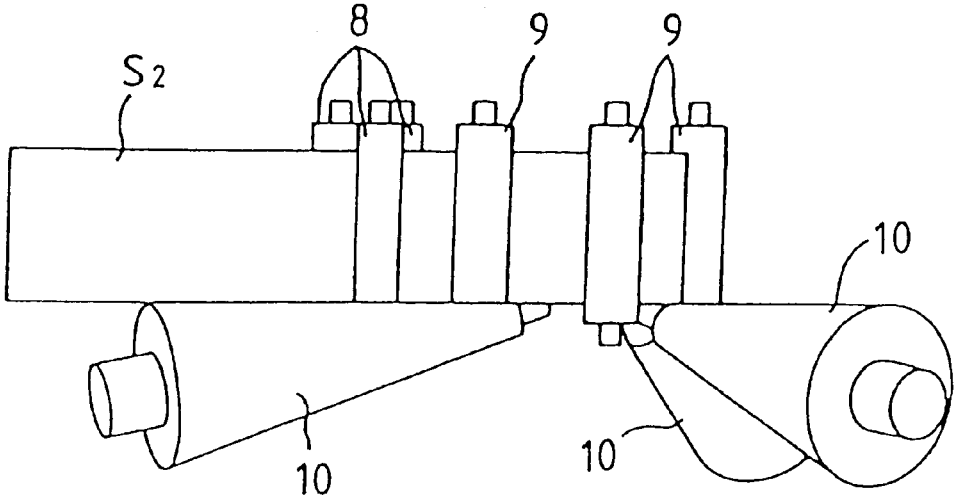

FIG. 4 perspectively shows the essential portion of the winder without the mandrel, and FIGS. 5(*a*) and 5(*b*) present a top plan view and a front elevation of the mandrel-less winder. The winder, as shown in FIG. 4 and FIGS. 5(*a*) and 5(*b*), is enabled to bend the sheet bar S2 at a predetermined curvature with bending rolls 8. The leading end of the sheet bar S2, as bent by the bending rolls 8, is fed to three forming rolls 9, as exemplified, so that the sheet bar S2 is coiled and taken up while being turned on a turn table composed of three table rolls 10. Here, the bending rolls 8 and the forming rolls 9 are freely moved outward as the coil diameter increases, and are enabled to adjust the curvature of the sheet bar coil SC1 in accordance with the increase in the coil diameter by adjusting the gap of the bending rolls 8. Here, the turntable, as shown in FIG. 4 and FIGS. 5(*a*) and 5(*b*) , is composed of the three table rolls 10 which are arranged radially of the center of the turns of the coil. However, the invention should not be limited thereto but may exemplify the turntable by a disc-shaped one. Since this disc-shaped turntable is troubled by a temperature drop at the lower face of the coil, however, there is advantageously employed the construction which is composed of the table rolls 10, as shown in FIG. 4 and FIGS. 5(*a*) and 5(*b*).

Figure 6A:
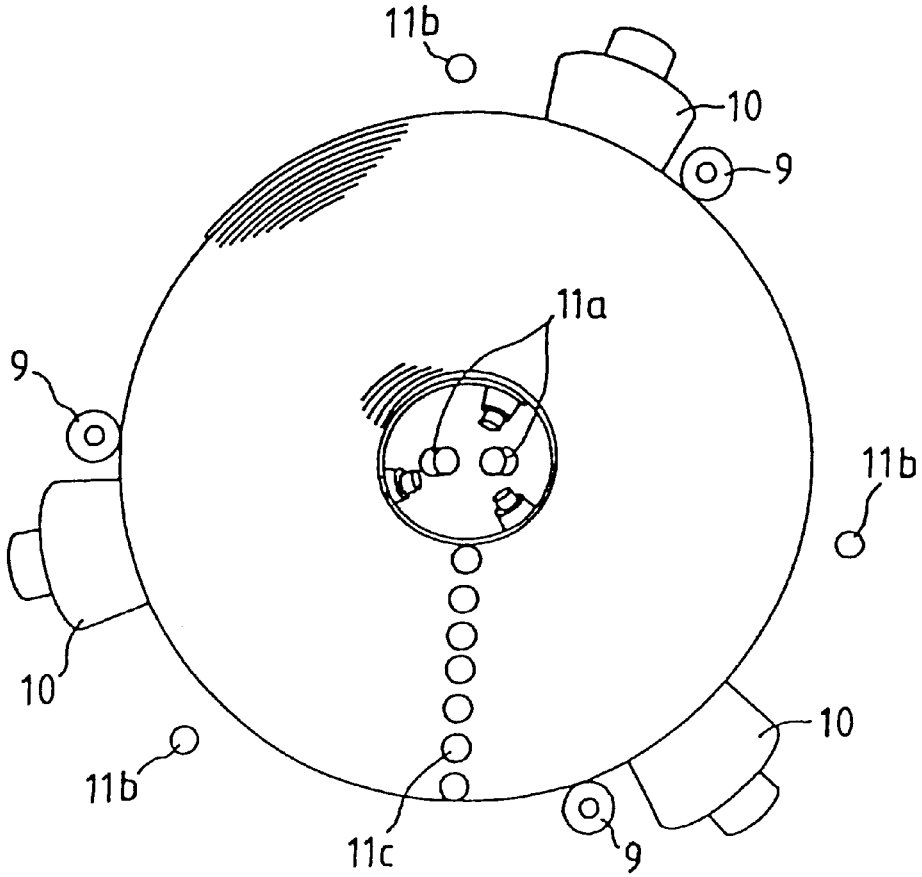
FIGS. 6(*a*) and 6(*b*) present diagrams showing the state in which heating burners are arranged.
Figure 6B:
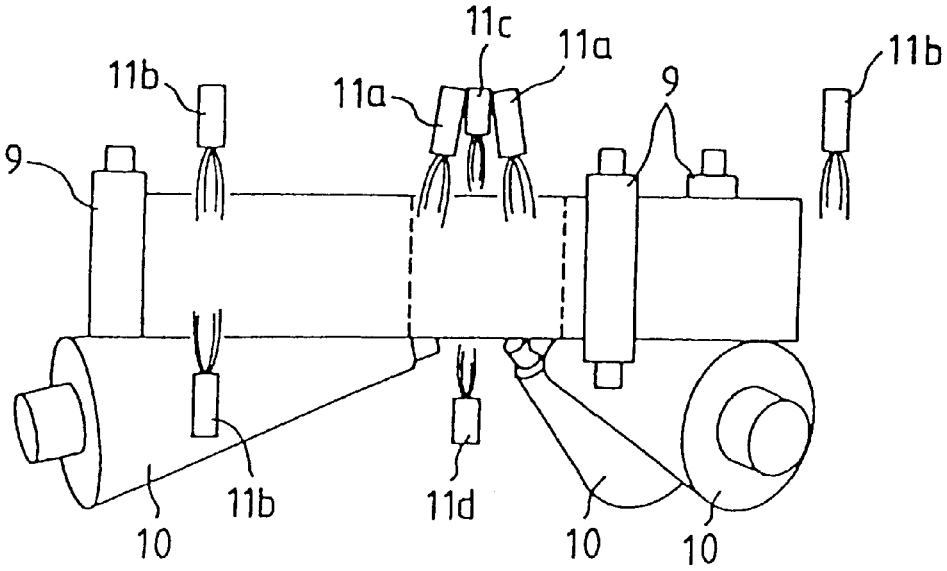
Figure 7A:
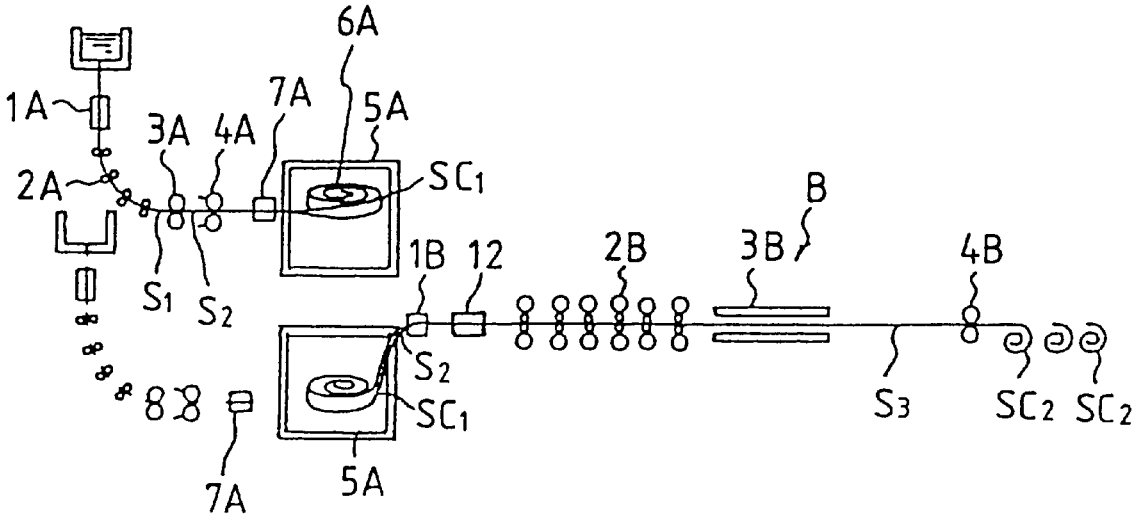
FIGS. 7(*a*) and 7(*b*) are schematic diagrams of a sheet bar caster, a sheet bar induction heater and a rolling apparatus, as suited for practicing the invention.
Figure 7B:
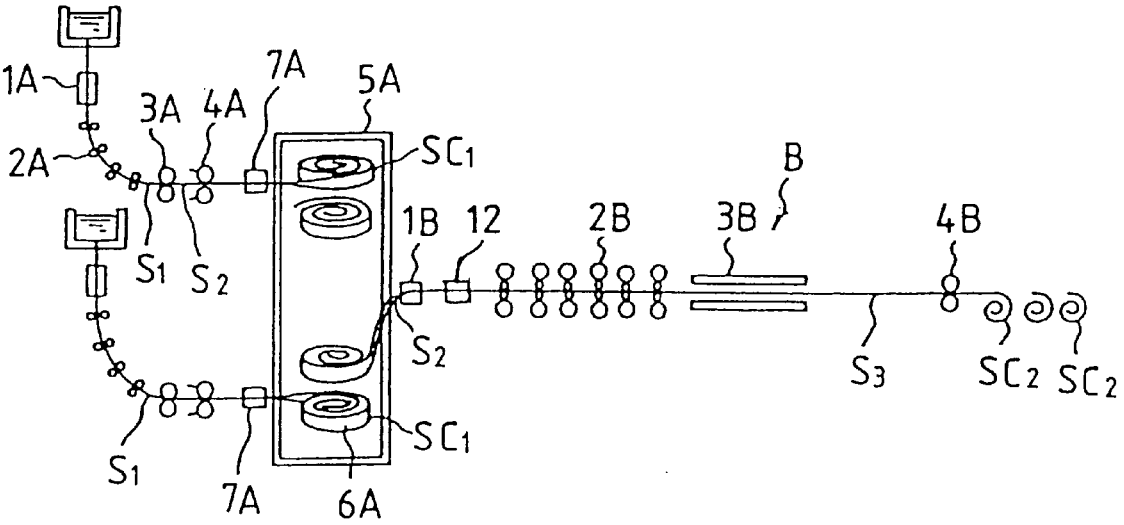

In order to compensate for the temperature drop at the inner side and the outer side of the sheet bar coil SC1 and to further reduce the temperature fluctuation in the coil, on the other hand, it is preferable to heat or thermally hold the inner and outer sides. This heating means may be exemplified either by heating the inner and outer sides of the sheet bar coil SC1 with burners 11*a* and 11*b*, as shown in FIG. 6, or by interposing an induction heater 12 between the twister 1B and the finish-rolling mill 2B, as shown in FIGS. 7(*a*) and 7(*b*), to heat the leading end portion and the trailing end portion, as corresponding to the inner side and the outer side of the coil, of the wound coil. In short, it is important to reduce the temperature fluctuation in the sheet bar coil SC1 at the entrance side of the finish-rolling mill, and it is desired to heat or hold the temperature thereby to confine the temperature fluctuation within 50° C. by employing the above-specified means.

When the sheet bar coil SC1 is to be held, moreover, it is possible that the temperature drops at the two widthwise end portions of the sheet bar coil SC1, i.e., at the upper and lower sides of the sheet bar coil SC1. It is, therefore, desired to heat the upper side and/or the lower side of the sheet bar coil SC1 likewise with the heating means such as burners 11*c* and 11*d* thereby to minimize the temperature fluctuation. Alternatively, the sheet bar coil SC1 may be inserted, after being wound, into a heating furnace so that it may be heated as a whole.

As has been described hereinbefore, the invention is intended to improve the quality and yield of products by minimizing the ratio of the uneven portions, as appearing at every rolling operation at the leading end portion and the trailing end portion. It is the most efficient to roll one charge of a converter or an electric furnace by one run. Considering these points, it is preferable to set the unit weight of the sheet bar coil to at least 50 tons.

Thus, the invention can reduce the ratio of the uneven portions such as the leading end portion or the trailing end portion so that it is especially effective at the time of hot-rolling the sheet which is so thin, e.g., 1.6 mm or less that the uneven portions are hard to roll.

Figure 8:
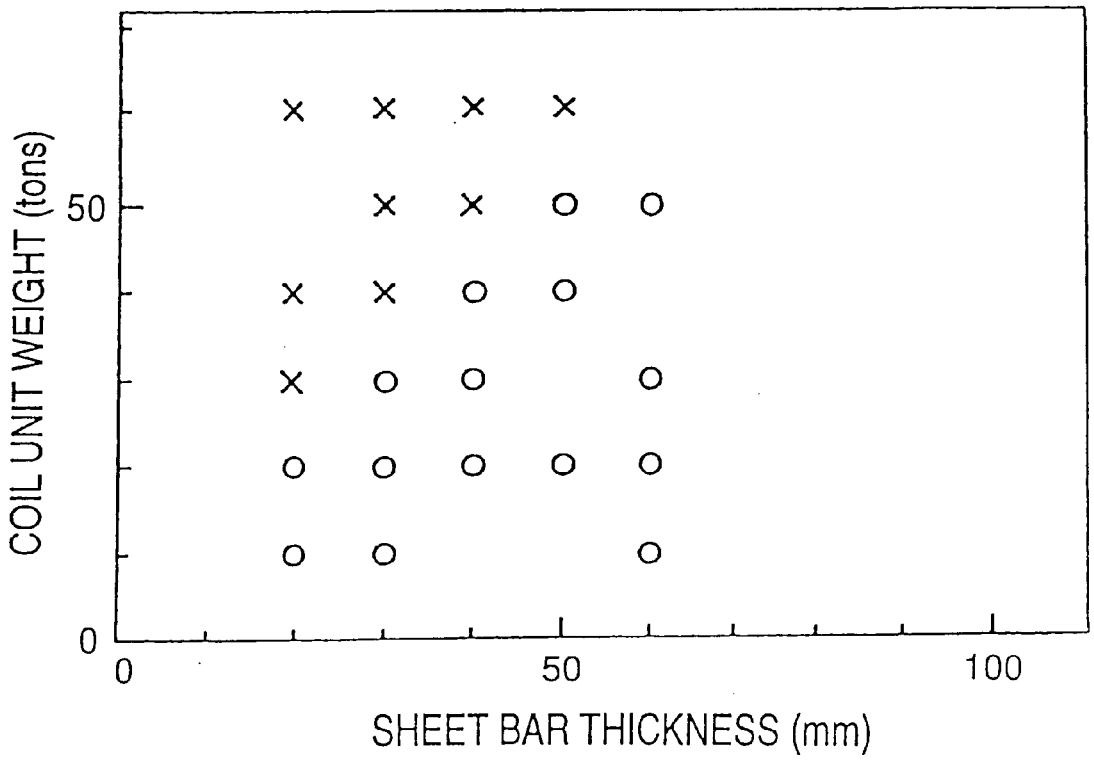
FIG. 8 is a diagram illustrating the influences of a sheet bar thickness and a coil unit weight upon coil deformations when the sheet bar is wound in a down-end state into a coil.

When the thin sheet having a thickness of 1.6 mm or less is to be finish-rolled, the thickness of the sheet is desired to be 40 mm or less considering the rolling capacity of the finish-rolling mill. However, the sheet bar having a unit weight of 50 tons or more and a thickness of 40 mm or less will be crushed by its own weight if it is wound in the down-end state. FIG. 8 illustrates the results of examinations of the influences of the sheet bar thickness and the unit weight to be exerted upon the coil deformations, when the sheet bar is wound in the down-end state into the coil. As illustrated in FIG. 8, it is found that the coil is crushed in the down-end state when the sheet bar has a thickness of 40 mm or less for the unit weight of 50 tons.

In the invention, however, the sheet bar is formed into the up-end sheet bar coil by winding it in the up-end state so that the up-end sheet bar coil is not crushed or scratched even if it has a large unit weight. Moreover, the up-end sheet bar coil can have a large unit weight, as described hereinbefore, so that the effects to improve the quality of the strip, the yield and the production efficiency can be achieved by rolling the coil of the large unit weight continuously at the downstream finish-rolling equipment line.

Here, the surface and the inside of the sheet bar can be thermally homogenized to have no temperature difference by winding it into a coil, so that no scale biting scratch is formed even by later finish-rolling like the hot-rolling of the prior art.

Moreover, the capacity of making the sheet bar using the sheet bar caster and the capacity of forming the formed sheet bar into the hot strip can be combined to run the individual rolling mills and the remaining facilities for forming the various hot strips can be continuously run without any standby, so that the expensive equipment can be effectively utilized.

EXAMPLE

The large unit weight hot-rolling process according to the invention was executed by using the rolling apparatus shown in FIG. 1(*a*). For comparison, hot strips were also made by the slabbing-high draft rolling process of the prior art, as disclosed in Unexamined Published Japanese Patent Application No. 59-92103.

As a result, the process of the invention could execute the completely continuous rolling at the unit of one heat size (200 to 300 tons) having a practical meaning and is superior to the comparison process especially in the following points.

According to the comparison process, more specifically, poor qualities such as scale biting scratches or roll marks were caused by the high draft rolling so that the production yield was up to 90%. According to the process of the invention, on the contrary, the qualities were not poor, and the production yield as high as 99.9% could be achieved.

According to the comparison process, moreover, the adjustments were made between the continuous slabbing rate and the rolling rate of the high draft rolling mill, and the work rolls of the high draft rolling mill were damaged. Then, the continuous slab had to be cut to run the continuous casting apparatus and the high draft rolling mill asynchronously. This trouble did not occur in the process of the invention.

The resultant effect is that the production yield per month rose by 20% more than the prior art.

As to the cost for facilities, moreover, the invention does not need the high draft rolling mill of the prior art so that it could omit the construction cost and the mill maintaining cost thereby to lower the mill cost by about 30%.

INDUSTRIAL APPLICABILITY

According to the invention, both the quality of the hot strip and the production yield can be simultaneously improved better than the slabbing-high draft rolling process of the prior art. Moreover, no trouble occurs during the run due to the high draft rolling so that the production efficiency can be improved. Still moreover, no cost is required for constructing and maintaining the high draft rolling mill so that the mill cost can be lowered.

What is claimed is:

1. A large unit weight hot-rolling process for sheet bars, comprising:

passing a sheet bar having a thickness of 20 to 50 mm, as continuously cast by a sheet bar caster and without heavy rolling, through a first sheet bar twister and then winding it in an up-end state into an up-end sheet bar coil;

unwinding said up-end sheet bar coil;

finish-rolling the unwound sheet bar coil through a second sheet bar twister; and winding the finish rolled sheet into a hot coil.

2. A large unit weight hot-rolling process for sheet bars, comprising:

passing a sheet bar having a thickness of 20 to 50 mm, as continuously cast by a sheet bar caster and then lightly rolled without heavy rolling, through a first sheet bar twister and then winding it in an up-end state into an up-end sheet bar coil;

unwinding said up-end sheet bar coil;

finish-rolling the unwound sheet bar coil through a second sheet bar twister; and winding the finish rolled sheet into a hot coil.

3. A large unit weight hot-rolling process for sheet bars according to claim 2, wherein light rolling is performed at a reduction of 3 to 10%.

4. A large unit weight hot-rolling process for sheet bars according to claims 1, 2 or 3, wherein said sheet bar is bent, before wound in the up-end state, at a predetermined curvature by a bending roll and fed to a forming roll so that it is wound while being turned on a turntable.

5. A large unit weight hot-rolling process for sheet bars according to claim 4, wherein the curvature predetermined is controlled according to the coil diameter of said sheet bar coil by adjusting the gap of said bending roll.

6. A large unit weight hot-rolling process for sheet bars according to any of claims 1 to 2, wherein a plurality of sheet bar casters are arranged in parallel and run sequentially at the time interval which is determined by a rolling rate determined according to the production plan of said finish-rolling equipment line.

7. A large unit weight hot-rolling process for sheet bars according to any of claims 1 to 2, wherein said sheet bar coil has a unit weight of 50 tons or more.

8. A large unit weight hot-rolling process for sheet bars according to any of claims 1 to 2, wherein said thickness of sheet bar is 40 mm or less.

9. A large unit weight hot-rolling process for sheet bars according to any of claims 1 to 2, wherein at an entrance side of the finish-rolling mill, the temperature fluctuation in said sheet bar coil is controlled within 50° C.

10. A large unit weight hot-rolling process for sheet bars according to claim 9, wherein before the finish rolling, the portions correspond to the inner side and the outer side of said up-end sheet bar coil are heated.

11. A large unit weight hot-rolling process for sheet bars according to claim 9, wherein before the finish rolling, the upper and/or lower sides of said up-end sheet bar coil are heated.

12. A large unit weight hot-rolling process for sheet bars according to claim 9, wherein before the finish rolling, said up-end sheet bar coil is heated or thermally held as a whole.

13. An apparatus for hot-rolling a large unit weight sheet bar coil continuously, comprising:

(1) at least one sheet bar caster;

(2) at least one light draft rolling mill operatively directly connected to the sheet bar caster;

(3) a first sheet bar twister disposed downstream of the light draft rolling mill and upstream of a winder to wind a sheet bar coil, for reorienting a lightly rolled sheet bar from a horizontal position to an upright position;

(4) at least one winder downstream of the twister for winding the sheet bar coil in an up-end state;

(5) a device for thermally holding or heating said up-end sheet bar coil positioned downstream of the winder;

(6) at least one unwinder positioned to receive up-end sheet bar coils from the thermal holding or heating device and for unwinding said up-end sheet bar coil;

(7) a second sheet bar twister disposed just downstream of an unwinder for unwinding said up-end sheet bar coil, for reorienting the sheet bar from the upright position to the horizontal position; and (8) a finish-rolling mill downstream of the second twister.

14. An apparatus for hot-rolling a large unit weight sheet bar coil continuously according to claim 13, wherein the winder for winding the sheet bar coil in the up-end state includes:

(9) a bending roll for bending said sheet bar to a predetermined curvature;

(10) a forming roll; and

(11) a table roll.

15. An apparatus for hot-rolling a large unit weight sheet bar coil continuously according to claim 14, wherein said bending roll and said forming roll have such a structure that they can move freely outward as the coil diameter increases.

16. An apparatus for hot-rolling a large unit weight sheet bar coil continuously according to claim 14, wherein said bending roll controls the curvature according to the coil diameter of said sheet bar coil by adjusting its gap.

17. An apparatus for hot-rolling a large unit weight sheet bar coil continuously according to any of claims 13 or 14, wherein the device for thermally holding or heating said up-end sheet bar coil includes an inner side heating burner and an outer side heating bumer.

18. An apparatus for hot-rolling a large unit weight sheet bar coil continuously according to any of claims 13 or 14, wherein the device for thermally holding or heating said up-end sheet bar coil includes an upper side heating burner and a lower side heating burner.

19. An apparatus for hot-rolling a large unit weight sheet bar coil continuously according to any of claims 13 or 14, wherein the device for thermally reserving or heating said up-end sheet bar coil includes a heating furnace for heating said up-end sheet bar coil as a whole.

20. An apparatus for hot-rolling a large unit weight sheet bar coil continuously according to any of claims 13 or 14, wherein the device for thermally reserving or heating said up-end sheet bar coil is replaced by an induction heating device interposed between said unwinder and said finish-rolling mill for heating said sheet bar.

* * * * *